US007051405B2

(12) United States Patent
Leinders

(10) Patent No.: US 7,051,405 B2
(45) Date of Patent: May 30, 2006

(54) DEVICE ON A DRAW FRAME FOR TEXTILE SLIVERS, HAVING ROLLER PAIRS ARRANGED ONE AFTER THE OTHER AND A ROLLER-CLEANING DEVICE

(75) Inventor: Christoph Leinders, Korschenbroich (DE)

(73) Assignee: Trützschler GmbH & Co.KG, Mönchengladbach (DE)

( * ) Notice: Subject to any disclaimer, the term of this patent is extended or adjusted under 35 U.S.C. 154(b) by 0 days.

(21) Appl. No.: 10/952,745

(22) Filed: Sep. 30, 2004

(65) Prior Publication Data

US 2005/0076475 A1 Apr. 14, 2005

(30) Foreign Application Priority Data

Oct. 10, 2003 (DE) ..... 103 47 192

(51) Int. Cl.
*D01H 5/00* (2006.01)

(52) U.S. Cl. ..... 19/236

(58) Field of Classification Search ..... 19/236, 19/245, 258, 262, 263, 264, 265, 290, 295
See application file for complete search history.

(56) References Cited

U.S. PATENT DOCUMENTS 3,287,768 A * 11/1966 Rakhorst ..... 19/200
4,406,039 A * 9/1983 Hotz ..... 19/262
5,799,374 A * 9/1998 Strobel et al. ..... 19/274
5,953,793 A * 9/1999 Roder ..... 19/266
6,032,336 A * 3/2000 Fujiwara ..... 19/258
6,134,752 A * 10/2000 Gohler et al. ..... 19/272

FOREIGN PATENT DOCUMENTS

| | | |
|---|---|---|
| DE | 1 038 465 A | 3/1952 |
| DE | 19 80 780 | 3/1968 |
| DE | 195 48 840 A1 | 7/1997 |
| DE | 197 04 815 A1 | 8/1998 |
| DE | 198 07 801 A1 | 8/1999 |

* cited by examiner

*Primary Examiner*—Gary L. Welch
(74) *Attorney, Agent, or Firm*—Venable LLP; Robert Kinberg

(57) ABSTRACT

In a device on a draw frame for textile slivers, having roller pairs arranged one after the other and a cleaning device, for example a cleaning lip, cleaning rod, for each upper roller, in which the loading device for each upper roller has at least two presser elements, the cleaning device is mounted on the loading device.

In order to avoid impairment of the resilient covering of the upper roller when a presser element has been raised and to allow adaptable and stable guidance/mounting, each cleaning device is mounted by its ends on a presser element and the presser element has a bearing element for the cleaning device.

24 Claims, 3 Drawing Sheets

DEVICE ON A DRAW FRAME FOR TEXTILE SLIVERS, HAVING ROLLER PAIRS ARRANGED ONE AFTER THE OTHER AND A ROLLER-CLEANING DEVICE

CROSS REFERENCE TO RELATED APPLICATION

This application claims priority from German Patent Application no. 103 47 192.8 filed on 10 Oct. 2003, the entire disclosure of which is incorporated herein by reference

BACKGROUND OF THE INVENTION

The invention relates to a device on a draw frame for textile slivers, having roller pairs arranged one after the other and a cleaning device, for example a cleaning lip, cleaning rod, or the like for one or more of the upper rollers.

In such form of draw frame, a loading device for each upper roller has at least two presser elements, for example pneumatic cylinders, each having a reciprocating component, for example a presser rod, piston rod, and the cleaning device is mounted on the loading device.

The draw frame is used to draft slivers, the slivers being clamped between two roller pairs with different rotational speeds. The roller pairs generally consist of a lower roller of steel and an upper roller having a resilient covering. The resilient covering has a tendency to wind up the silver. This is a very gradual process and begins with the picking-up of individual fibres. In order to avoid winding-up, attempts are made to remove these individual fibres from the upper roller and supply them to an extraction device by means of a cleaning bar (cleaning rod), which is usually round. The cleaning bar and the upper roller have to be arranged as far as possible axially parallel, so that linear contact is achieved. Otherwise the contact between the two components would be confined to a point and the cleaning action would thus be markedly reduced.

The guidance of the cleaning bar is generally effected by additional elements having guide grooves which have to be positioned relative to the upper roller. In a known device (DE 198 07 80) a holder for receiving a cleaning lip for the upper roller is provided on the pressure cylinder. When the loading device is pivoted away, the cleaning lip can also be pivoted away therewith. The holder has an elongate hole in which a journal of the cleaning lip is guided. A disadvantage is that when the upper roller bearing is relieved of load, that is to say when the piston rod has been lifted away from the upper roller bearing but the cylinder is still in position, the cleaning bar remains lying on the rubber covering of the upper roller. The rubber covering has an elevated operating temperature and is frequently sticky with honeydew, resulting in an undesirable linear load on the stationary rubber covering. A further problem is that the mounting arrangement of the journal of the cleaning lip in a vertical elongate hole on each side of the upper roller can give rise to a clamping moment. In practice, fibre material can become lodged in the elongate hole, namely between the journal and the inner walls of the elongate hole. As a result, the cleaning bar is unable to move away from the rubber covering.

It is an aim of the invention to provide a device of the kind described at the beginning which avoids or mitigates the mentioned disadvantages, which especially avoids impairment of the resilient covering of the upper roller when the piston rod is raised and which allows adaptable and stable guidance and mounting.

SUMMARY OF THE INVENTION

The invention provides a drawing system for textile slivers, having successive pairs of rollers, at least one roller pair comprising a lower roller, an upper roller, a cleaning device for said upper roller, and a loading device for said upper roller, in which:

said loading device comprises first and second presser elements;

said cleaning device comprises an elongate cleaning member having first and second ends mountable, respectively, at said first and second presser elements; and each of said first and second presser elements comprise a bearing element for a said cleaning-member end.

Because the cleaning bar is associated with the presser rods, when the presser rods are relieved of load and subsequently lifted away from the upper roller bearings, the cleaning bar is lifted away from the rubber covering. Local pressure on the rubber covering is thus avoided. In addition, the scope for horizontal movement of the cleaning bar on the piston rods allows adaptable and stable guidance/mounting of the cleaning bar. Because the cleaning bar is exactly positioned relative to the upper roller, a better cleaning performance is achieved, the build-up of windings is reduced and thus the efficiency of the machine is increased. The reduction in the number of components (guide elements) reduces soiling in the drafting system and consequently increases the intervals between cleaning operations.

The cleaning device may be, for example, a cleaning bar or a cleaning rod. The cleaning device may be a stripper. The upper roller may have a resilient covering, for example of rubber or the like. The cleaning device may make contact with the upper roller, or with the resilient covering of the upper roller, from above, substantially under the effect of gravity. The cleaning device may make contact with the upper roller, or with the resilient covering of the upper roller, substantially along a line. That line may extend axially parallel to the upper roller. The cleaning device is advantageously displaceably mounted in two bearing elements. The bearing elements may be associated with the cleaning device and/or with the presser rods. The bearing elements may be supports. The cleaning device is advantageously displaceable, for example, in the vertical direction or in the horizontal direction. The cleaning device, for example the cleaning bar, may advantageously have at each of its ends an encompassing element, for example a fork or the like. Each fork element may engage around a respective presser rod. Each fork element may be attached to the cleaning bar, for example, by screws, rivets, adhesives or the like. The or each attached fork element may advantageously consist wholly or partially of a vibration-damping material, for example plastics material. The or each fork element may be formed on the cleaning bar by non-cutting shaping, for example forging, pressing or the like. The presser rod may have a support for the cleaning bar. The support may project beyond the diameter of the presser rod. The support may consist of a resilient material, for example rubber. The support may be a rubber ring. The rubber ring may be partly engaged in a recess in the presser rod, for example a peripheral groove. The rubber ring may rest on a turned groove in the presser rod. The presser rod may have as bearing element a recess in which an end region of the cleaning bar engages. The recess may be continuous. Advantageously, there is play between the internal surfaces of the fork element and the outer surface of the presser rod. Advantageously, there is play between the outer surfaces of the end regions of the cleaning bar and the inner surface of the recess.

BRIEF DESCRIPTION OF THE DRAWINGS

FIG. 1 shows a drafting system S of a draw frame, for example of the kind known as the HSR draw frame, made by Trützschler GmbH & Co. KG of Mönchengladbach, Germany. The drafting system S is configured as a 4 over 3 drafting system, that is to say it consists of three lower rollers I, II, III (I output lower roller, II middle lower roller, III input lower roller) and four upper rollers 1, 2, 3, 4. In the drafting system S, the drafting of the fibre bundle 5, which consists of a plurality of slivers, is carried out. The drafting operation is composed of the preliminary drafting operation and the main drafting operation. The roller pairs 4/III and 3/II form the preliminary drafting zone and the roller pairs 3/II and 1,2/I form the main drafting zone. The output lower roller I is driven by the main motor (not shown) and thus determines the delivery speed. The input and middle lower rollers III and II are driven by a regulating motor (not shown). The upper rollers 1 to 4 are pressed against the lower rollers I, II and Ill by presser elements $\mathbf{9}_1$ to $\mathbf{9}_4$ (loading device) in presser arms 11*a* to 11*d* which are rotatable about pivot bearings (see FIGS. 3 and 4) and are thus driven by way of frictional engagement. The direction of rotation of the rollers I, II, III; 1, 2, 3, 4 is indicated by curved arrows. The fibre bundle 5, which consists of a plurality of slivers, runs in direction A; the lower rollers I, II, III are each mounted in a pair of stands (one of which is shown as stand 14*a*; see FIG. 2) which are arranged on the machinery frame 15.

Figure 1:
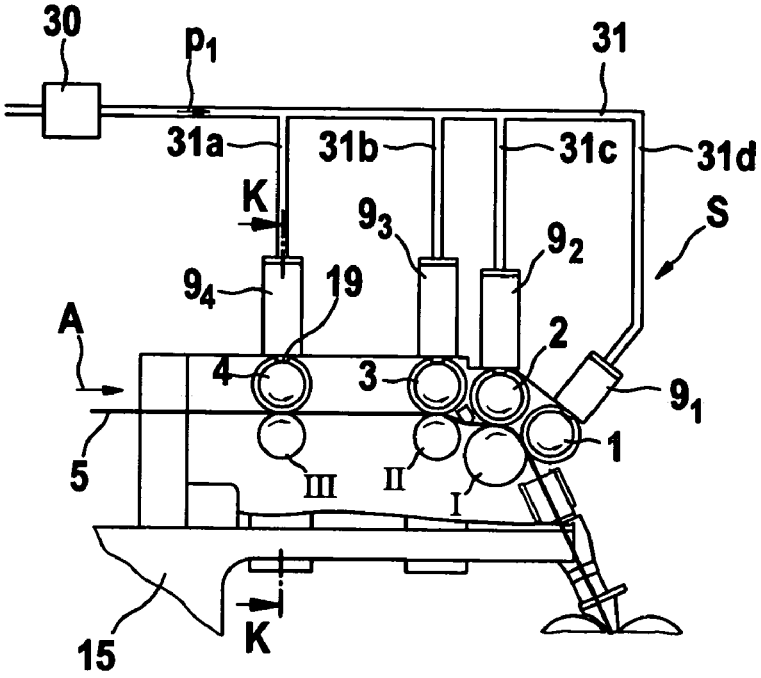
FIG. 1 is a diagrammatic side view of a drafting system of a draw frame having a device according to the invention.
Figure 2:
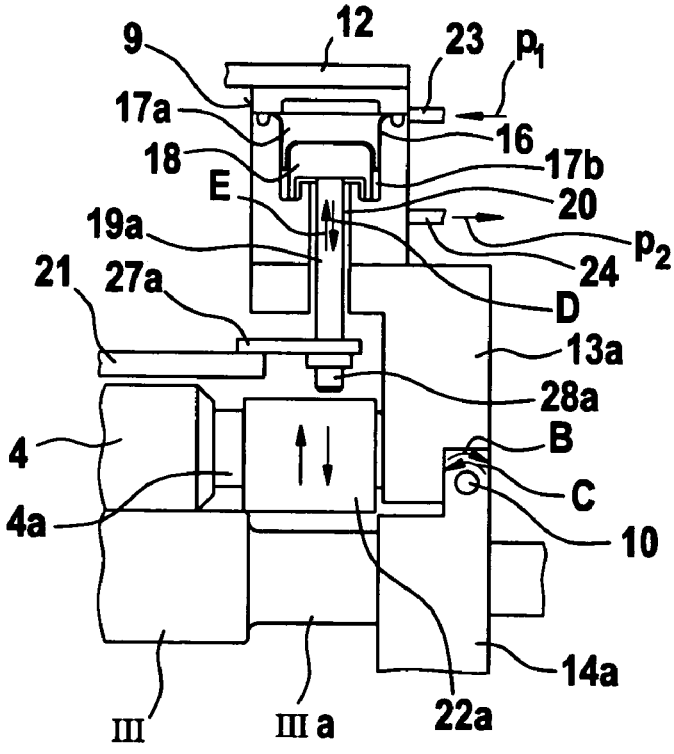
FIG. 2 shows part of the device FIG. 1 in section, corresponding to line K—K (FIG. 1), with a pneumatic upper roller loading device.

According to FIG. 2, the pneumatic cylinder 9 is associated at the top with a support element 12 and at the bottom with a holding element 13*a*. The pneumatic cylinder 9 forms a cylinder unit with a cylinder cavity 17 having two portions 17*a* and 1 7*b* in which a piston 18 is guided by means of a presser rod 19*a* in a sliding bush 20. The roller journal 4*a* of the presser roller 4 engages in a bearing 22*a*. The bearing 22*a* accommodating the presser roller 4 extends into a chamber between the presser rod 19*a* and the roller journal IIIa of the lower roller III. The bearing 22*a* is mounted on the holding element 13*a*. A membrane 16 divides the cylinder cavity 17 in terms of pressure. In order that pressure is generated in the upper portion of the cylinder cavity 17, the latter can be supplied with compressed air $p_1$ by means of a compressed air connection 23. The lower portion of the cylinder cavity 17 is vented by means of a venting bore 24. The upper portion of the cylinder cavity 17 can be vented and the lower portion of the cylinder cavity 17 can be supplied with compressed air in corresponding manner. In operation, after a fibre bundle 5 has been guided over the lower rollers I, II, III, the presser arms 11 are pivoted into the operating position shown in FIG. 3 and fixed in that position by a fastening device (not shown), so that the presser rollers 1, 2, 3, 4 are able to exert pressure. Such a pressing action is produced on the one hand by the fact that the presser rods 19 (only 19*a* is shown in FIG. 2, with a further presser rod 19*b* being present at the other end of roller 4) each rest on the corresponding bearing 22 and on the other hand because an overpressure has been generated in the cavity above the membrane 16. As a result, the presser rod 19 presses with its other end on the bearing 22 in order to create the mentioned pressing action between upper roller 4 and the lower roller (drive roller) III. The presser rod 19 is displaceable in the direction of arrows D, E. The resilient covering surface of the upper roller 4 is associated with a cleaning bar 21, for example a steel rod.

Figure 3:
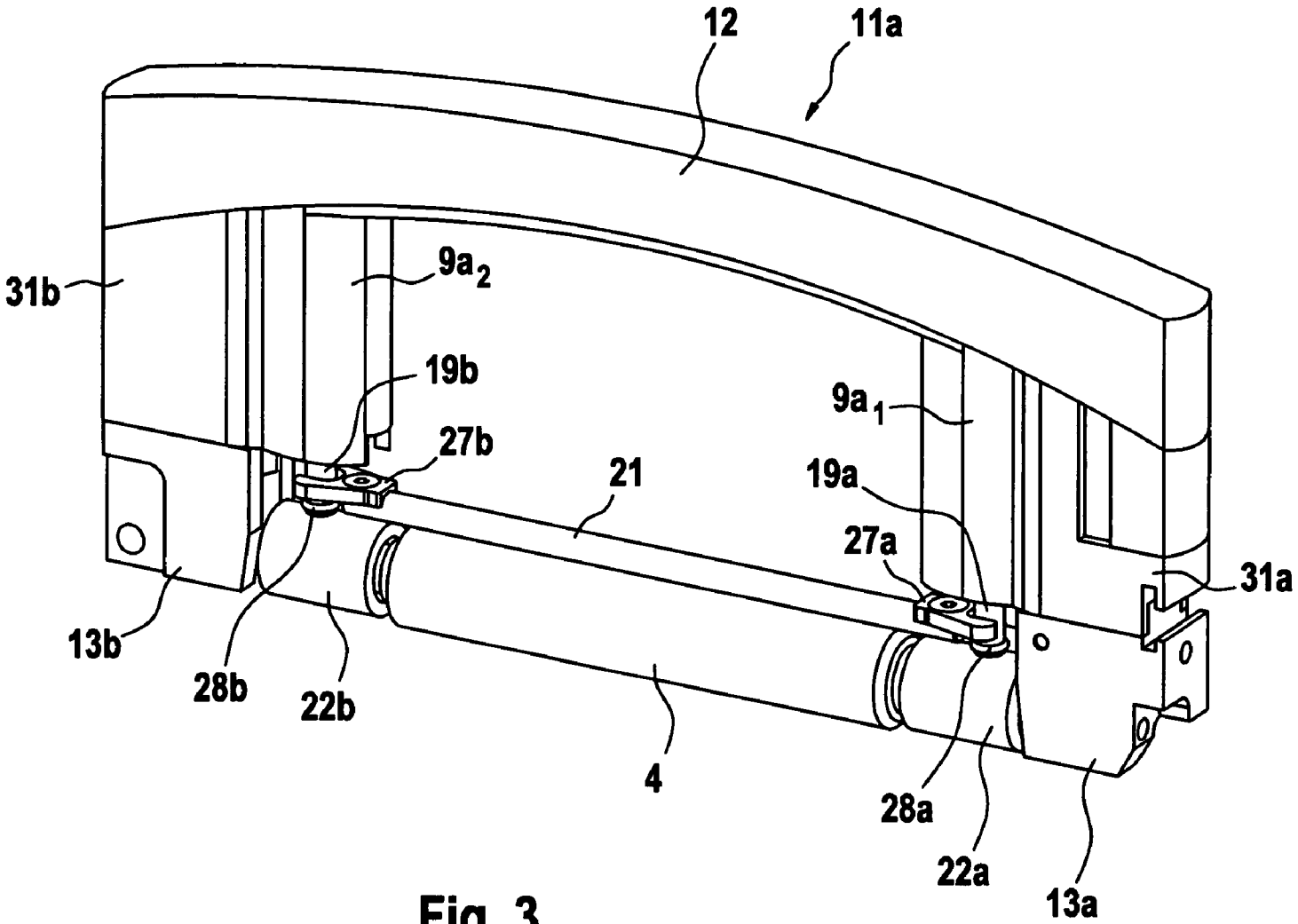
FIG. 3 is a perspective view of a presser arm with integral housing, two presser rods and a cleaning bar.

With reference to FIG. 3, the upper roller 4 is associated with a portal-shaped presser arm 11*a*. (The upper rollers 1 to 3 are associated with a corresponding presser arm 11—not shown). The presser arm 11*a* is in the form of a housing of glass-fibre-reinforced plastics and is produced by injection-moulding. The housing is an integral component which is of unitary construction and comprises the support element 12, the two bodies of the pressure elements $\mathbf{9}a_1$ and $\mathbf{9}a_2$ (pressure cylinders), two intermediate elements 31*a* and 31*b* and two holding elements 13*a* and 13*b*. During operation, the cleaning bar 21 is located—as shown in FIG. 3—on the upper roller 4 and acts as a stripper. The cleaning bar 21 has at each of its two ends a fork 27*a*, 27*b*, which are, for example, screwed to the cleaning bar 21. The forks 27*a*, 27*b* consist of vibration-damping plastics in order to prevent the excitation of vibrations of the cleaning roller 21 on the upper roller. Its arrangement on the piston rods 19*a*, 19*b* enables the cleaning bar 21 to be positioned exactly relative to the upper roller 4, because the guidance of the upper roller 4 and the position of the piston rods 19*a*, 19*b* is ensured by the presser arm 11.

The forks 27*a* and 27*b* are located on two resilient elements, e.g. two O-rings 28*a* and 28*b*, respectively, which are mounted on the piston rods 19*a* and 19*b*, respectively. As a result, the cleaning bar 21 is prevented from falling downwards, for example from the piston rods 19*a*, 19*b*. For removal, the cleaning bar 21 needs merely be pulled by the fork over the resilient element from one side. The cleaning bar 21 is inserted by the reverse procedure. The forks 27*a*, 27*b* can be supported on the O-rings 28*a* and 28*b*, respectively, under gravity. There is advantageously play between the forks 27*a*, 27*b* and the presser rods 19*a*, 19*b*.

Figure 4A:
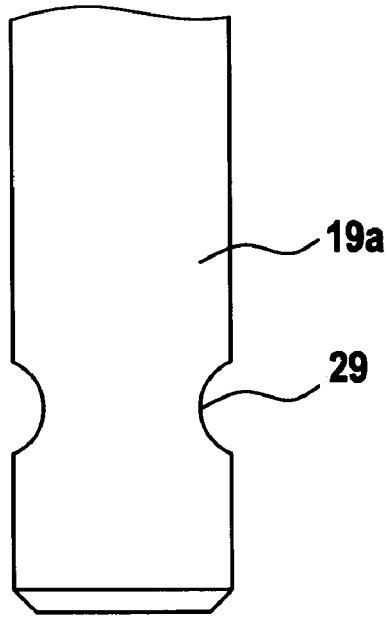
FIG. 4*a* is a front view of a presser rod with a turned groove.
Figure 4B:
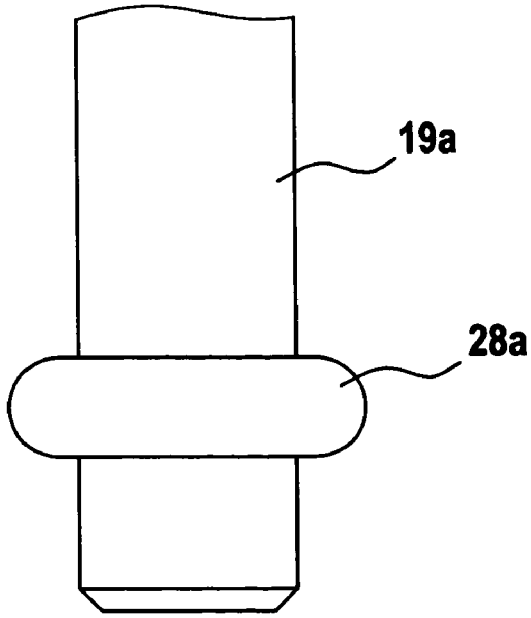
FIG. 4*b* is a front view of the presser rod of FIG. 4*a* with an 0-ring engaged in the groove.

Referring to FIG. 4*a*, the presser rod 19*a* has a peripheral turned groove 29 into which, according to FIG. 4*b*, a resilient O-ring 28*a* has been snapped.

In FIG. 2, the presser rod 19*a*, out of operation, has been pneumatically relieved of load and lifted away from the upper roller bearing 22*a* by distance a. As a result, the O-ring 28*a* is moved in direction E and accordingly, by way of the fork 27*a*, the cleaning bar 21 is at the same time raised by distance b relative to the upper roller 4.

Although the foregoing invention has been described in detail by way of illustration and example for purposes of understanding, it will be obvious that changes and modifications may be practised within the scope of the appended claims.

What is claimed is:

1. A drawing system for textile slivers, having successive pairs of rollers, at least one roller pair comprising a lower roller, an upper roller, a cleaning device for said upper roller, and a loading device for said upper roller, in which:

said loading device comprises first and second presser rods;

said cleaning device comprises an elongate cleaning member having first and second ends mountable, respectively, at said first and second presser rods; and each of said first and second presser rods comprise a bearing element for a said cleaning-member end.

2. A drawing system according to claim 1, in which the cleaning device is a cleaning bar or a cleaning rod.

3. A drawing system according to claim 1, in which the cleaning device is a stripper.

4. A drawing system according to claim 1, in which the upper roller has a resilient covering.

5. A drawing system according to claim 1, in which the cleaning device makes contact with the upper roller from above, substantially under the effect of gravity.

6. A drawing system according to claim 1, in which the cleaning member makes contact with the upper roller substantially along a line that extends axially parallel to the upper roller.

7. A drawing system according to claim 1, in which the cleaning member is displaceably mounted in two bearing elements.

8. A drawing system according to claim 7, in which the bearing elements are associated with the cleaning device.

9. A drawing system according to claim 7, in which the bearing elements are associated with the presser rods.

10. A drawing system according to claim 1, in which the cleaning device is displaceable in the vertical direction.

11. A drawing system according to claim 1, in which the cleaning device is displaceable in the horizontal direction.

12. A drawing system according to claim 1, in which the cleaning member has at each of its ends a forked region.

13. A drawing system according to claim 12, in which each forked region engages around one of said presser rods.

14. A drawing system according to claim 12, in which the forked region is a fork element attached to the cleaning bar.

15. A drawing system according to claim 14, in which the attached fork element consists wholly or partially of a vibration-damping material.

16. A drawing system according to claim 12, in which the forked region is integrally formed on the cleaning member by non-cutting shaping.

17. A drawing system according to claim 1, in which each presser rod has a support for the cleaning bar.

18. A drawing system according to claim 17, in which the support comprises a resilient material and projects beyond the diameter of the presser rod.

19. A drawing system according to claim 18, in which the support is a rubber ring.

20. A drawing system according to claim 19, in which the rubber ring is partly engaged in a recess in the presser rod.

21. A drawing system according to claim 1, in which at least one of said presser rods has as a bearing element a recess in which an end region of the cleaning bar engages.

22. A drawing system according to claim 1, in which there is play between those surfaces of the presser rods that engage with the cleaning member and the corresponding surfaces of the cleaning member.

23. A drawing system according to claim 1, comprising at least three roller pairs, each of which has an upper roller with a said cleaning device mounted on first and second presser rods of said upper roller, said first and second presser rods each comprising a bearing element for a said cleaning member end.

24. A device on a draw frame for textile slivers, having roller pairs arranged one after the other and a cleaning device, for example a cleaning lip, cleaning rod, for each upper roller, in which the loading device for each upper roller has at least two presser elements, for example pneumatic cylinders, each having a reciprocating component, for example a presser rod, piston rod, and the cleaning device is mounted on the loading device, wherein each cleaning device is mounted by its ends on a presser rod, and the presser rod has a bearing element for the cleaning device.

* * * * *